US007541992B2

(12) United States Patent
Murakami et al.

(10) Patent No.: US 7,541,992 B2
(45) Date of Patent: Jun. 2, 2009

(54) MOBILE RADIO COMMUNICATION DEVICE

(75) Inventors: Toshiyuki Murakami, Setagaya-ku (JP); Takaaki Ueno, Tachikawa (JP); Masanori Kaneoya, Musashimurayama (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 43 days.

(21) Appl. No.: 11/818,274

(22) Filed: Jun. 13, 2007

(65) Prior Publication Data

US 2008/0001832 A1 Jan. 3, 2008

(30) Foreign Application Priority Data

Jun. 28, 2006 (JP) ..... 2006-178678

(51) Int. Cl.
*H01Q 1/12* (2006.01)

(52) U.S. Cl. ..... 343/702; 343/873

(58) Field of Classification Search ..... 343/702, 343/873, 872

See application file for complete search history.

(56) References Cited

U.S. PATENT DOCUMENTS

| | | | | |
|---|---|---|---|---|
| 4,123,756 | A * | 10/1978 | Nagata et al. | 343/702 |
| 4,701,763 | A * | 10/1987 | Yamamoto et al. | 343/700 MS |
| 4,723,305 | A * | 2/1988 | Phillips et al. | 455/575.7 |
| 4,980,694 | A | 12/1990 | Hines | |
| 5,555,459 | A * | 9/1996 | Kraus et al. | 343/702 |
| 5,977,917 | A | 11/1999 | Hirose | |
| 6,054,954 | A * | 4/2000 | Eggleston et al. | 343/700 MS |
| 6,326,927 | B1 * | 12/2001 | Johnson et al. | 343/702 |

FOREIGN PATENT DOCUMENTS

| | | |
|---|---|---|
| EP | 1 401 111 A2 | 3/2004 |
| JP | 5-39055 | 5/1993 |
| JP | 06-037876 | 2/1994 |
| JP | 07-099403 | 4/1995 |
| JP | 2000-048449 | 2/2000 |
| JP | 2000-209014 | 7/2000 |
| JP | 2002-319808 | 10/2002 |

OTHER PUBLICATIONS

European Search Report for the corresponding European Application No. EP 07 01 0902 (6 pgs.).
Office Action (with English translation) dated May 13, 2008 issued for the counterpart Japanese Patent Application No. 2006-178678, (5 pgs.).

* cited by examiner

*Primary Examiner*—Tho G Phan
(74) *Attorney, Agent, or Firm*—Cohen Pontani Lieberman & Pavane LLP

(57) ABSTRACT

A mobile radio communication device has an antenna, a circuit board to which the antenna is connected and on which a plurality of electronic elements are mounted, an inner casing formed of resin and housing the circuit board, and an outer casing of resin covering the inner casing. The antenna is located on that portion on an outer face of the inner casing which is covered by the outer casing, and the antenna is disposed to penetrate into the inside of the inner casing through a hole formed on the inner casing, and the feeding end of the antenna is connected to the circuit board. This allows the antenna to be spaced apart from other electronic elements on the circuit board in the lower body without protruding the antenna outside, to achieve a sufficient antenna property by elimination of effects from other electronic elements.

3 Claims, 7 Drawing Sheets

MOBILE RADIO COMMUNICATION DEVICE

BACKGROUND OF THE INVENTION

1. Field of the Invention

The present invention relates to a mobile radio communication device, such as a mobile phone.

2. Description of the Related Art

Mobile radio communication devices, particularly mobile phones, equipped with built-in antenna are becoming gradually dominant in their field where a whip-antenna has been in the place of mainstream (see, for example, Unexamined Japanese Patent Application KOKAI Publication No. 2002-319808). By having an antenna built-in the casing, a mobile radio communication device can furnish improved waterproofness and a higher mechanical strength, as well as allowing flexibility in the design of the casing.

By the way, an antenna of the mobile radio communication device should preferably be spaced apart from other built-in electronic elements within the device, for achieving insusceptibility to such other electronic elements and a lesser effect the antenna would have on such elements. With recent advancements in multi-functionalization of the mobile communication devices, however, the number of built-in electronic component in casings is increasing, and it is becoming difficult to realize such an antenna installation as to obtain sufficient antenna property.

An object of the present invention is to provide a mobile radio communication device in which an antenna locates so as to achieve a less influence between the antenna and the other electronic devices and a sufficient antenna property.

SUMMARY OF THE INVENTION

To achieve the above problem, according to an aspect of the present invention, a mobile radio communication device comprises an antenna having the feeding end; a circuit board to which the antenna is connected and on which a plurality of electronic elements are mounted; an inner casing formed of resin and housing the circuit board; and an outer casing formed of resin and covering the inner casing, wherein the antenna is located on that portion on an outer face of the inner casing which is covered by the outer casing, and the antenna is disposed to penetrate into the inside of the inner casing through a hole formed on the inner casing, to connect the feeding end thereof to the circuit board.

This structure allows the antenna to be spaced apart from other electronic elements on the circuit board in the casing without protruding the antenna outside. Therefore, it is possible to achieve a sufficient antenna property by elimination of the effect from other electronic devices, and to achieve a lesser effect which the antenna would have on such elements.

In a mobile radio communication device according to the present invention, the antenna may be located on that portion on an outer face of a side wall of the inner casing, which is covered by a side wall of the outer casing.

In the mobile radio communication device in which the antenna is located on an outer face of a side wall of the inner casing, the hole may be formed on the side wall of the inner casing.

In a mobile radio communication device according to the present invention, the hole may be sealed by a packing formed of an elastic material.

In the mobile radio communication device in which the hole is sealed by a packing formed of an elastic material, the packing may be formed integrally with the antenna.

In the mobile radio communication device in which the packing that seals the hole is formed integrally with the antenna, the hole may have a noncircular shape, and the packing may have a form corresponding to the form of the hole.

In a mobile radio communication device according to the present invention, the antenna may be formed of an anticorrosive metal.

In a mobile radio communication device according to the present invention, the antenna may be composed of a thin metal plate.

In the mobile communication device in which the antenna is composed of a thin metal plate, the antenna may comprise a positioning hole and the outer face of the side wall of the inner casing may comprise a positioning pin to be inserted to the positioning hole upon attachment of the antenna to the outer face of the side wall of the inner casing.

In a mobile radio communication device according to the present invention, the antenna may be a monopole antenna.

In a mobile radio communication device according to the present invention, the number of antenna provided may be plural.

In a mobile radio communication device according to the present invention, the number of antenna provided may be plural, the plurality of antennas may penetrate into the inside of the inner casing through a hole formed on the inner casing, to connect the feeding end thereof to the circuit board, and the hole may be sealed by a single packing formed of elastic material.

In the mobile communication device of such structure, the packing may be attached integrally to the plurality of the antennas to thereby constitute a unitary part with the antennas.

In a mobile communication device according to the present invention, two antennas having respective feeding ends may be placed across the hole, the two antennas may penetrate into the inside of the casing through the hole to locate the feeding end inside the inner casing, and the hole may be sealed by a single packing formed of an elastic material.

In a mobile communication device according to the present invention, the packing may be attached integrally to the two antennas to thereby constitute a unitary part with the two antennas.

BRIEF DESCRIPTION OF THE DRAWINGS

These objects and other objects and advantages of the present invention will become more apparent upon reading of the following detailed description and the accompanying drawings, in which.

DETAILED DESCRIPTION OF THE PREFERRED EMBODIMENT

A detailed description of the present invention will be given in the following.

Figure 1C:
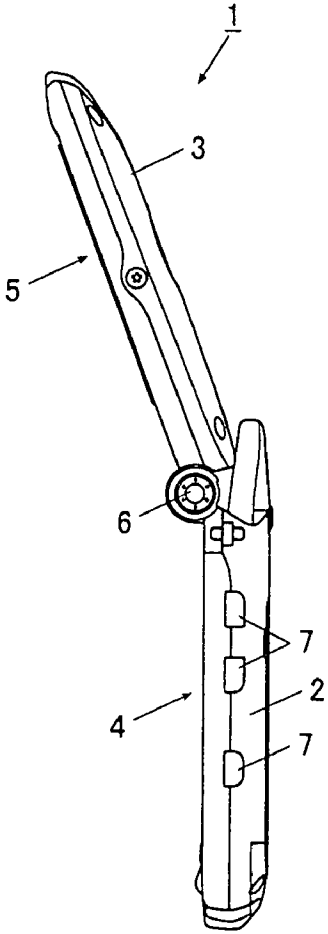
FIG. 1C is a right side view of the mobile radio communication device 1.
Figure 1B:
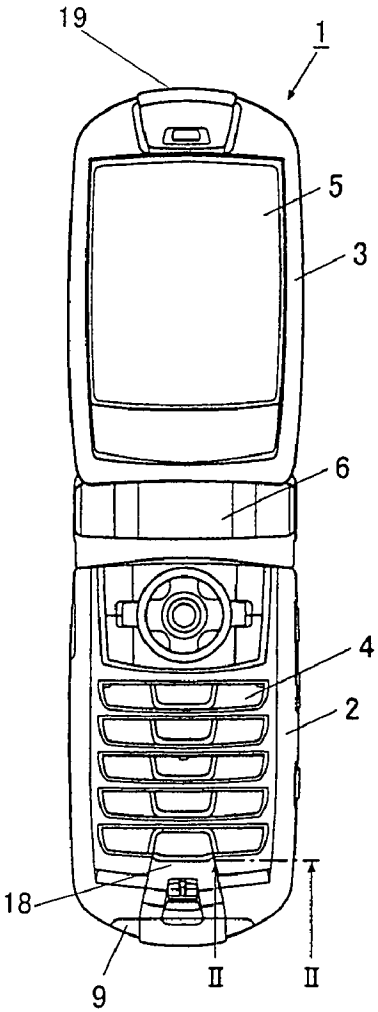
FIG. 1B is a front view of the mobile radio communication device 1.
Figure 1A:
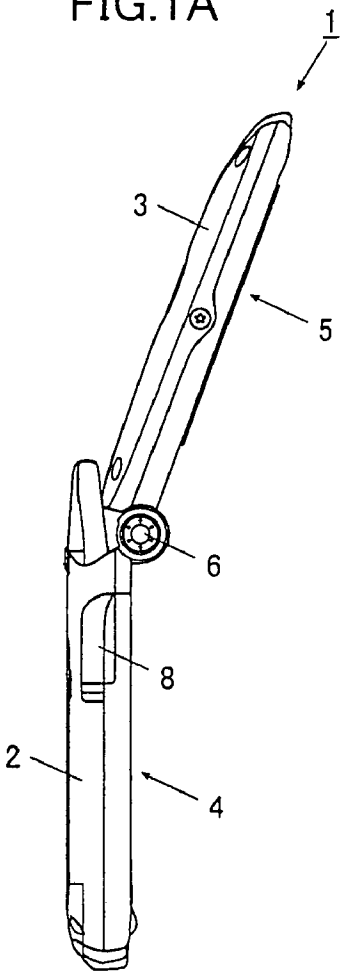
FIG. 1A is a left side view of a mobile radio communication device 1 according to the present embodiment.

FIG. 1A is a left side view showing a mobile radio communication device 1 according to an embodiment of the present invention. FIG. 1B shows the front view of the same, and FIG. 1C shows the right side view. As shown in FIGS. 1A through 1C, the mobile radio communication device 1 comprises a lower body 2 having a control pad section 4 and a telephone microphone 18, and an upper body 3 having a display section 5 and a telephone earphone 19. The lower body 2 and the upper body 3 are connected by a hinge unit 6, so that the upper body 3 can fold flat on the top of the lower body 2. On a side face of the lower body 2, a side key 7, a year phone cover 8 and a connector cover 9 are provided.

Figure 2:
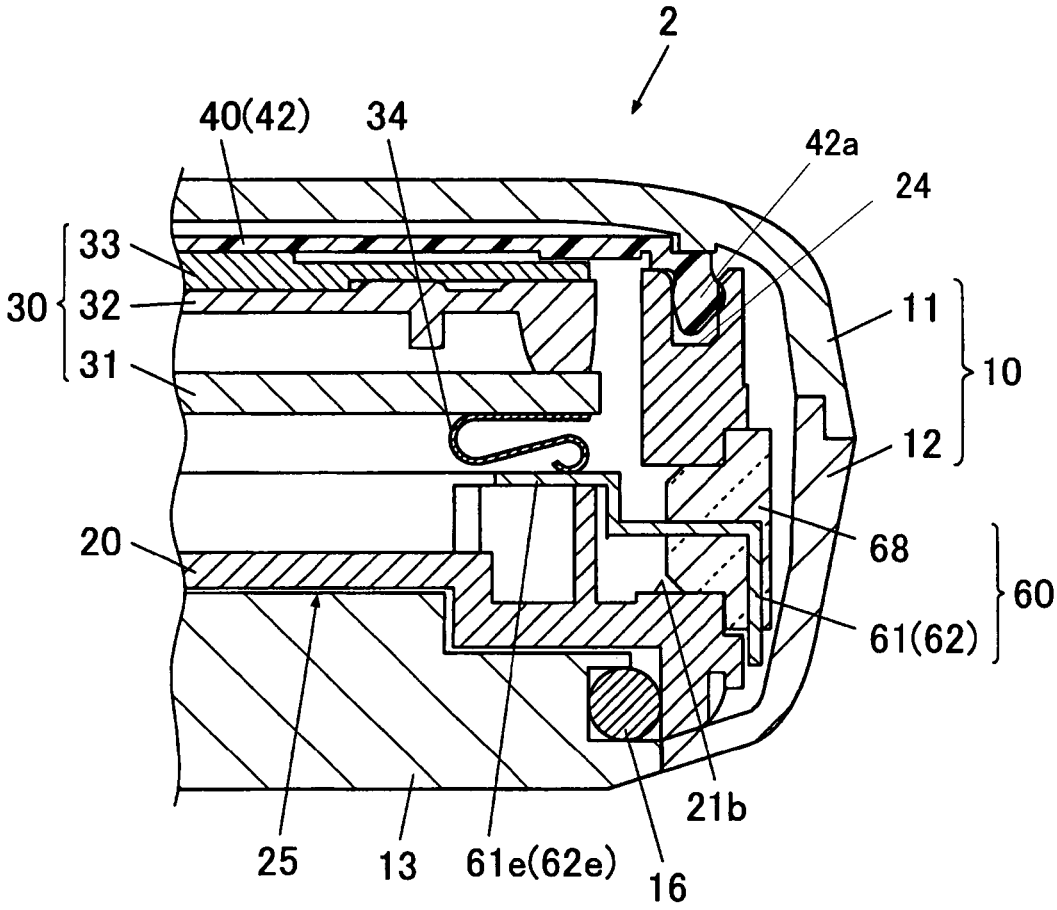
FIG. 2 is a fragmentary cross-sectional view taken in the direction of arrows II-II of FIG. 1B, substantially along the line indicated by the arrows.
Figure 3:
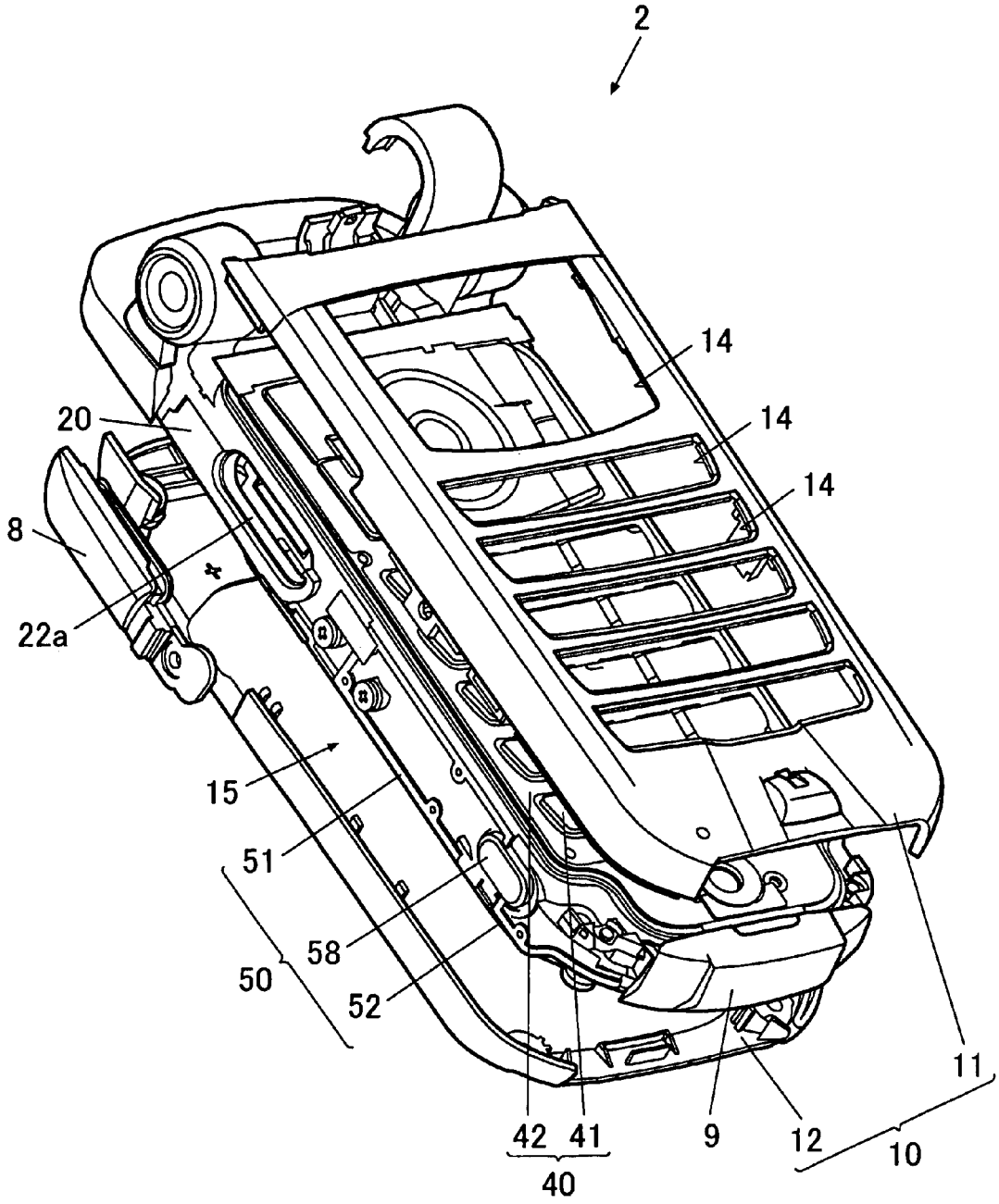
FIG. 3 is an exploded perspective view of the lower body 2 of the mobile radio communication device 1.

FIG. 2 is a fragmentary cross-sectional view taken in the direction of the arrows II-II of FIG. 1B, substantially along the line indicated by arrows. FIG. 3 shows an exploded perspective view of the lower body 2. The lower body 2 has an outer casing 10, an inner casing 20, a circuit module (circuit unit) 30 and a key pad 40, etc.

A front case 11 to fit on the side of control pad section 4 and a rear case 12 constitutes an outer casing 10. Both the front case 11 and a rear case 12 are formed of synthetic resin.

The front case 11 has apertures 14 through which to expose key tops 41 of a key pad 40 provided on the front face of an inner casing 20. The rear case 12 has an aperture 15 to expose a battery 13 provided on a back of the inner casing 20 (see FIG. 2). The battery 13 has an integrated battery cover.

Figure 4:
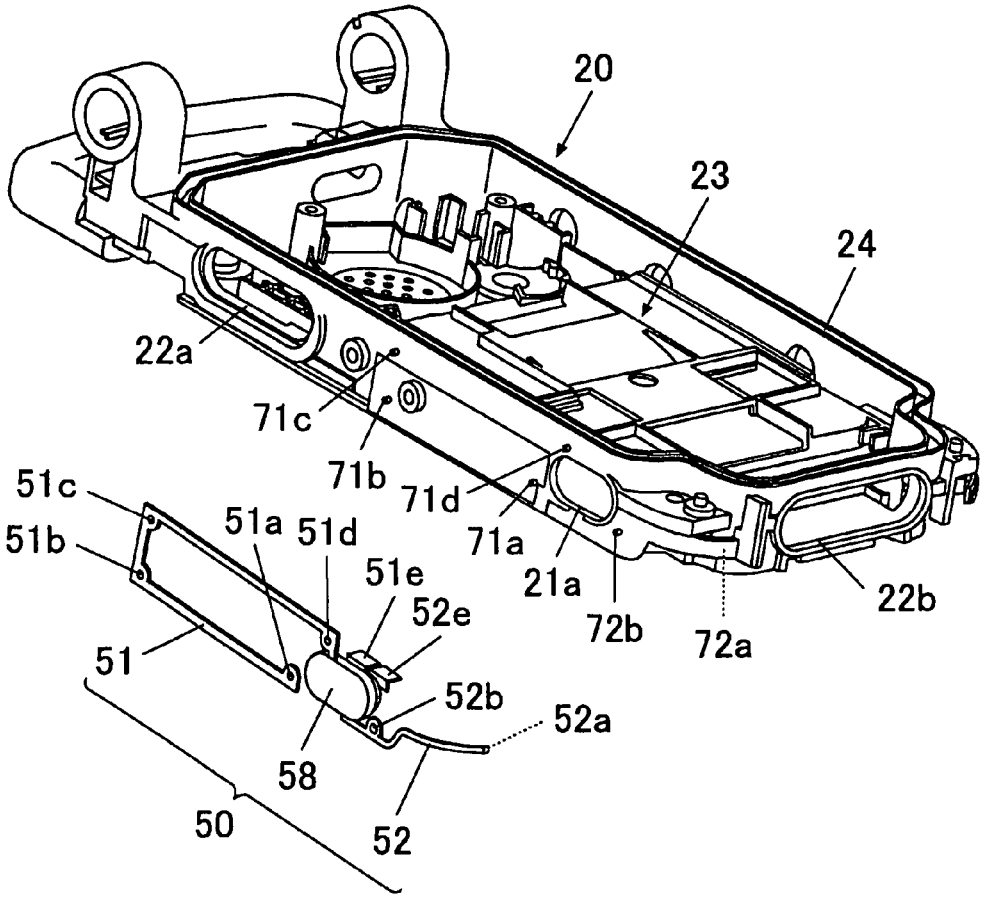
FIG. 4 is a perspective view showing the front face, the left face and the bottom face of an inner casing 20.
Figure 5:
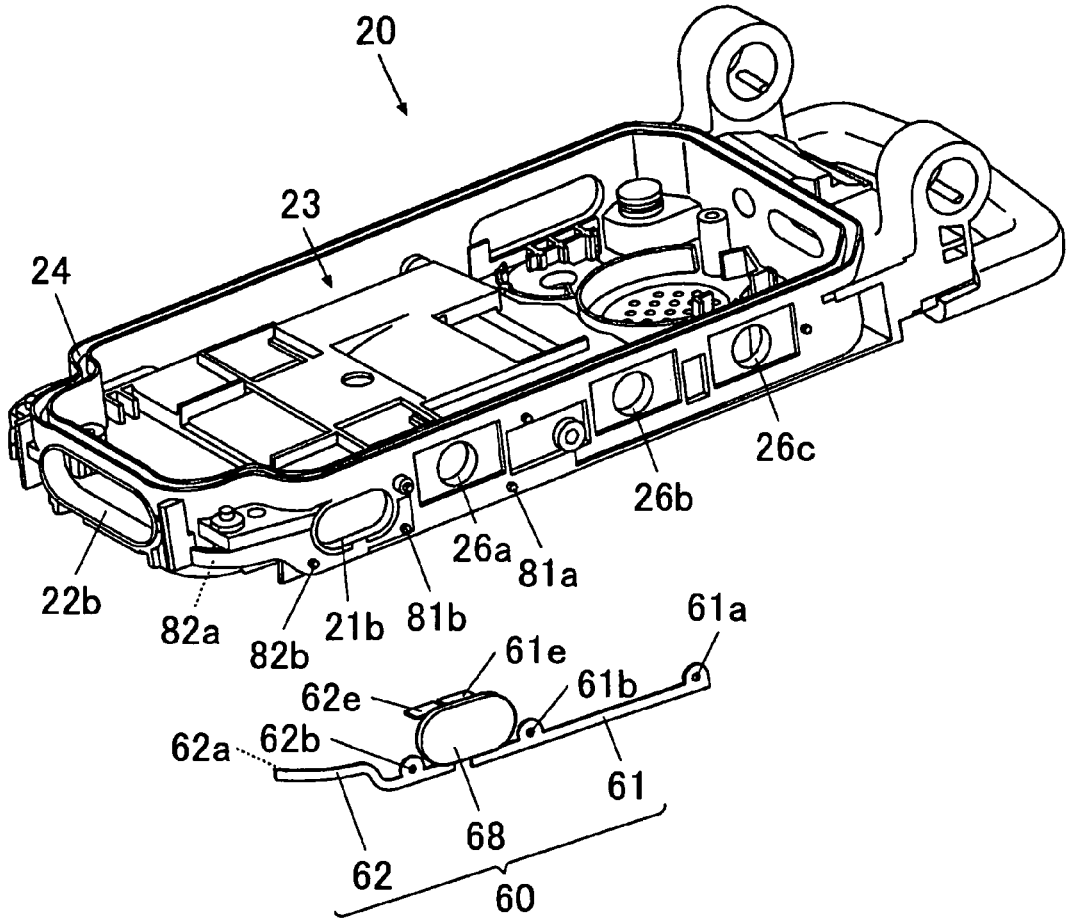
FIG. 5 is a perspective view showing the front face, right face and bottom face of the inner casing 20.

The inner casing 20 is formed of a synthetic resin, and has a storage recess 23 in the front side (see FIG. 4 or FIG. 5). Inside the storage recess 23 a circuit module 30 and a key pad 40 are stored. Further, around the aperture of the storage recess 23, the inner casing 20 has a slot 24 into which to fit a thick portion 42*a* of a later-described key pad rubber 42, around the rim of the key pad rubber 42.

A circuit module 30 comprises a main substrate 3 1(circuit board), a main frame 32 and a keypad circuit board 33. Mounted on the main substrate 31 are electronic elements such as a main processor, a memory, a modem, a power IC, an antenna, an IF connector, and an ear phone connector. As shown in FIG. 2, on the back of the main substrate 31 (in FIG. 2, on the bottom surface), a spring terminal 34 having substantially S-shape cross-section is provided. The spring terminal 34 contacts a feeding end of a later-described antenna members 50 and 60. The spring terminal 34 is provided in correspondence to each antenna, and FIG. 2 shows feeding end 61*e* (62*e*) of the antenna 61(62) contacting the spring terminal 34.

The main frame 32 is formed of, for example, a magnesium alloy to enhance the strength of the lower body 2, as well as serving as an electric ground and an electromagnetic wave shielding (noise shield). On the back of the main frame 32, one or a plurality of recess portions are formed, and there is provided the main substrate 31 in such a manner that the main processor, the memory, the modem, the power IC, etc. are stored in the recess portion.

The front face of the main frame 32 (in FIG. 2, upper surface) is a flat surface on which to locate a keypad circuit board 33. The key pad 40 is located on the top of the keypad circuit board 33.

The key pad 40 has a key pad rubber 42 placed on the keypad circuit board 33, and key tops 41 put on the top of the key pad rubber 42. The key pad rubber 42 is a sheet-like article formed of elastic materials including silicon rubber, and has a thick portion 42*a*, around the rim of the key pad rubber 42. As shown in FIG. 2, this thick portion 42*a* fits into a slot 24 of the inner casing 20 to close the storage recess 23, and prevents water from entering to the inner casing 20 from the front side where the front case 11 locates.

The key tops 41 are exposed through the aperture of the front case 11 and constitute control buttons on the control pad section 4.

On the back of the inner casing 20, a battery attachment section 25 (see FIG. 2) is formed. In the battery attachment section 25, a terminal of not-shown power-source connector attached on the back of the main substrate 31 is exposed. However, an O-ring 16 is provided around an outer circumference surface of battery 13, and this affords water-tight sealing between the inner casing 20 and the battery 13. Therefore, it is possible to prevent entrance of water to the vicinity of a portion in the inner casing where a terminal of the main substrate 31 and a terminal of the battery case are contacting each other (not shown).

Further, on the sidewall of the inner casing 20, as shown in FIG. 4 and FIG. 5, antenna holes 21*a* and 21*b*, an ear phone connector hole 22*a*, a communication cable connector hole 22*b*, side-key holes 26*a* to 26*c* are provided.

FIG. 4 is a perspective view of the front face, left side face, and bottom face of the inner casing 20. FIG. 5 is a perspective view showing a front face, right side face, and a bottom face of the inner casing 20.

The ear phone connector hole 22*a* is provided on the left side wall of the inner casing 20, and this connector hole 22*a* is covered by a year phone cover 8 in a watertight manner. The communication cable connector hole 22*b* is provided on the bottom side wall of the inner casing 20, and this connector hole 22*b* is covered by a connector cover 9 in a watertight manner. The side key holes 26*a* to 26*c* are provided on the right side wall of the inner casing 20, and these key holes 26*a* to 26*c* are covered by a rubber water-proof film in a watertight manner, so that the keys, when operated, press down switches provided within the inner casing 20 via the water-proof film.

The antenna hole 21*a* is provided on the left side wall of the inner casing 20, and the antenna hole 21*b* is provided on the right side wall of the inner casing 20. Into these antenna holes 21*a* and 21*b*, packing 58 and 68 of the antenna members 50 and 60 are fit. The following gives description of the antenna members 50 and 60.

Figure 6:
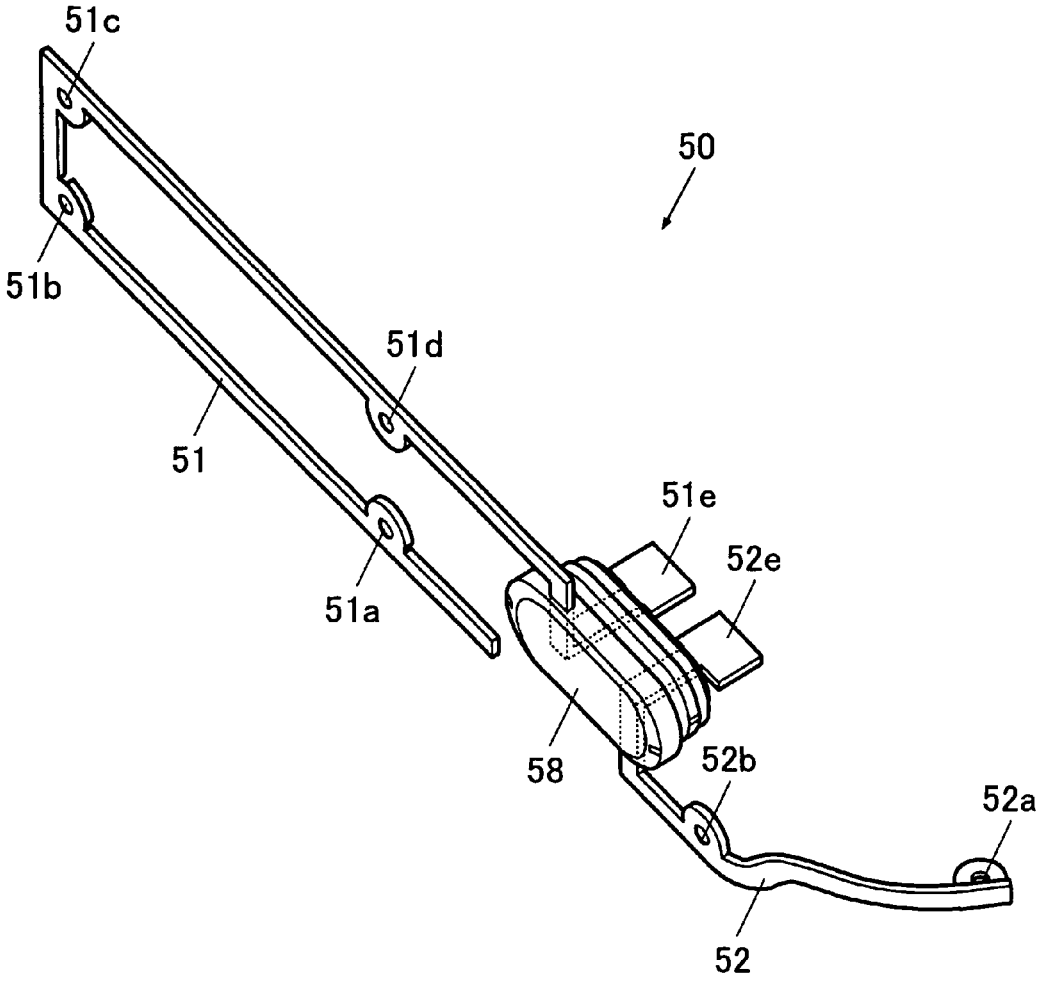
FIG. 6 is a perspective view showing an antenna member 50.
Figure 7:
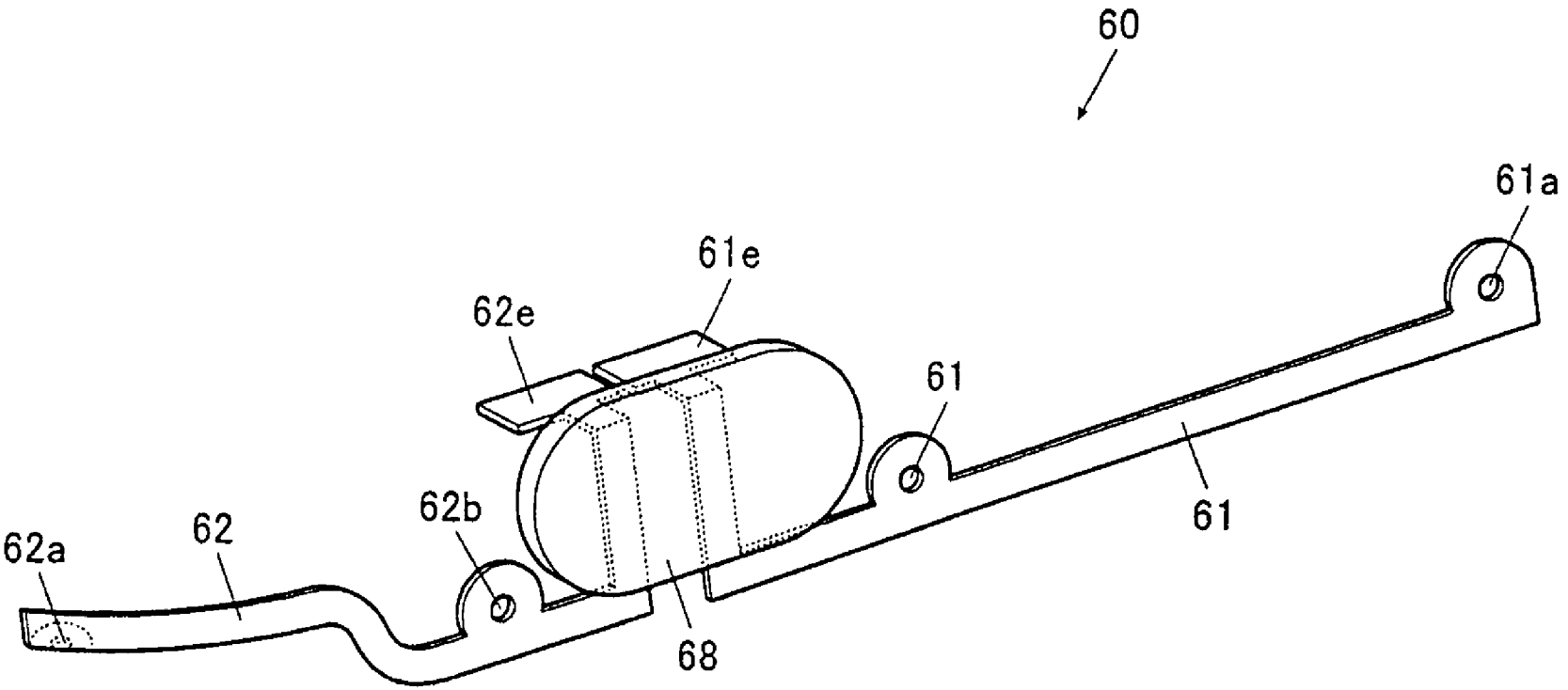
FIG. 7 is a perspective view showing an antenna member 60.

As shown in FIG. 6, the antenna member 50 comprises a first antenna 51, a second antenna 52 and a packing 58 to which these two antennas 51 and 52 are embedded. Further, as shown in FIG. 7, the antenna member 60 comprises a third antenna 61, a fourth antenna 62, and a packing 68 to which these two antennas 61 and 62 are embedded. The first to fourth antennas 51 to 62 are formed of a thin metal plate (preferably, thin plate of anticorrosive metal, such as stainless steel), and the packing 58 and 68 are formed of soft elastic materials including silicon rubber. The embedding of the antennas into the packing 58 and 68, in other words, the integration of the antenna and the packing can be performed relying on a well-known insertion molding.

The first antenna 51 to the fourth antenna 62 are formed so as to have respective electrical lengths suitable for communications using individually different wavelength.

The first antenna 51 is used for transmission and reception of the radio wave, for example of a band of 800 MHz for mobile phones, and the second antenna 52 is used for transmission and reception of a radio wave of a band of 2 GHz for mobile phones. Here, in the case where the first antenna 51 is used for transmission and reception of the radio wave of the band of 800 MHz, when the wavelength of 800 MHz is defined as λ1, the first antenna 51 is formed to have an electrical length of λ1/4. Similarly, in the case where the second antenna 52 is used for transmission and reception of the radio wave of the band of 2 GHz, when the wavelength of 2 GHz is defined as λ2, the second antenna 52 is formed to have an electrical length of λ2/4.

The third antenna 61 is used for, for example reception of L1 radio wave (1.57542 GHz) for a GPS(Global Positioning System), and the fourth antenna 62 is used for transmission and reception of a radio wave for a short distance wireless communication (for example, a radio wave of 2.45 GHz band for Bluetooth (registered trademark)). Here, in the case where the third antenna 61 is used for reception of L1 radio wave for GPS, when the wavelength of L1 radio wave of GPS is defined as λ3, the third antenna 61 is formed to have an electrical length of λ3/4. In the same way, in the case where the fourth antenna 62 is used for transmission and reception of a radio wave for Bluetooth, when the wavelength of the radio wave for Bluetooth is defined as λ4, the fourth antenna 62 is formed to have an electrical length of λ4/4. That is, all the first to fourth antennas 51 to 62 are constructed as monopole antennas.

In the first antenna 51, four positioning holes 51*a* to 51*d* are provided on respective positions. Thus positioning holes receive the insertion of positioning pins 71*a*-71*d* provided on the inner casing 20 (see FIG. 4) when the first antenna 51 is attached to the left face (outer face of the left side wall) of the inner casing 20.

In the same way, the second antenna 52 has two positioning holes 52*a* and 52*b* which are provided on their respective positions and receive insertion of positioning pins 72*a* and 72*b* provided on the inner casing 20 (see FIG. 4) when the second antenna 52 is attached to the left face of the inner casing 20.

The third antenna 61 has two positioning holes 61*a* and 61*b* provided on their respective positions. The positioning holes 61*a* and 61*b* receive insertion of positioning pins 81*a* and 81*b* provided on the inner casing 20, when the third antenna 61 is attached to the right side face (outer face of the right side wall) of the inner casing 20.

In the same way, the fourth antenna 62 has two positioning holes 62*a* and 62*b* which receive insertion of positioning pins 82*a* and 82*b* provided on the inner casing 20 (see FIG. 5) when the fourth antenna 61 is attached to the right side face of the inner casing 20.

The antennas 51, 52, 61 and 62 are bent in the vicinity of their respective feeding ends 51*e*, 52*e*, 61*e* and 62*e*, and these bent portion are embedded in the packing 58 and 68. In other words, the body of the antennas 51, 52, 61 and 62 and the respective feeding ends 51*e*, 52*e*, 61*e* and 62*e* are exposed from the packing 58 and 68.

As shown in FIG. 2, the packing 68 is inserted into the antenna hole 21*b* to seal the antenna hole 21*b* in a watertight manner. In the same way as the packing 68, the packing 58 is also inserted into the antenna hole 21*a* to seal the antenna hole 21*a* in a watertight manner. When the packing 58 and 68 are inserted into the antenna hole 21*a* and 21*b*, the feeding ends 51*e*, 52*e*, 61*e* and 62*e* of the antennas 51, 52, 61 and 62 are positioned within the inner casing 20, the spring terminal 34 of the main substrate 31 contacts the feeding ends 51*e*, 52*e*, 61*e* and 62*e* within the inner casing 20. On the other hand, the body portions of the antennas 51, 52, 61 and 62, are positioned along the outer circumference surface of the inner casing 20 (outer face of the side wall). The outer circumference surface of inner casing 20 along which the body portions of the antennas 51, 52, 61 and 62 are located is covered by the outer casing 10.

As described above, the antennas 51, 52, 61 and 62 are located along the outer circumference surface of the inner casing 20, and only feeding ends 51*e*, 52*e*, 61*e* and 62*e* are inserted into the inner casing 20 through the antenna holes 21*a* and 21*b*, and therefore the antennas 51, 52, 61 and 62 are sufficiently spaced apart from the electronic elements within the inner casing 20 (in other words, the electronic elements within the lower body 2). Accordingly, the antennas 51, 52, 61 and 62 is insusceptible to other electronic elements in the inner casing 20, and the effect which the antennas 51, 52, 61 and 62 have on other electronic elements is less. As a result, a sufficient antenna property can be obtained.

Further, since the outer circumference surface of the inner casing 20 to which the antennas 51, 52, 61 and 62 are attached is covered by an outer casing 10, the antennas 51, 52, 61 and 62 are not exposed outside the casing, and do not directly receive an external force.

Further, since the antenna holes 21*a* and 21*b* through which the feeding ends 51*e*, 52*e*, 61*e* and 62*e* of the antennas 51, 52, 61 and 62 are inserted into the inner casing 20 are stopped up by the packing 58 and 68, it is possible to prevent entrance of the water into the inner casing 20, and to protect the electronic elements inside.

Further, since the packing 58 (or 68) is integrally attached to antennas 51 and 52(or 61 and 62), it is easy to attach the antennas 51 and 52 (61 and 62) to the inner casing 20. That is, by only inserting packing 58 (or 68) to antenna holes 21*a* and 21*b*, antennas 51 and 52 (or 61 and 62) are attached to the outer face of the side wall of the inner casing 20 (at least temporarily tacked). Moreover, in the present embodiment, as shown in FIGS. 4 and 5 the antenna holes 21*a* and 21*b* are not round holes but oblong holes, and the packing 58 and 68 are of corresponding forms, the antennas 51 and 52 (or 61 and 62) are located on the outer face of the side wall of the inner casing 20 in a substantially optimal orientation when the packing 58 and 68 is inserted into antenna holes 21*a* and 21*b*.

Further, since on the antennas 51, 52, 61 and 62, the positioning holes 61*a*, 61*b* are formed, and on the outer face of the side wall of the inner casing 20 positioning pins are provided, the antennas come intimate contact with the outer face of the side wall of the inner casing 20 when the positioning pins are inserted into the positioning holes 61*a* and 61*b*. Accordingly, the antennas do not inhibit the attachment of the outer casing to the inner casing 20.

The present invention is not limited to the above embodiment, and various modification can be made within the scope of the present invention.

For example, the point, in the above embodiment, that the antenna is formed of a metal thin plate: a linear element can be applied. Further, the point in the embodiment, that two antennas are embedded to one packing: in a possible modification, one packing may have one antenna embedded thereto, and may have three or more antennas embedded. Further, it is possible to configure the antenna and the packing as separate parts. In this case, the workability in assemblage and waterproofness are a little inferior to that of the integrated antenna and packing structure (the structure in which the antenna is embedded to the packing) since the packing is inserted to the antenna hole of the inner casing after that the antenna has been inserted to the antenna hole of the packing, but, it is possible to fix the antenna.

Further, in the above embodiment, the antenna hole is formed in an oblong shape. However, another form may be successfully applied. In the integrated packing and antenna structure, it is preferable that the form of the antenna hole is noncircular shape if workability is taken care of.

In the above embodiment, an example in which the outer casing is constituted by the front case and the rear case, but, it is possible that the outer casing consists only of a front case. In this case, the structure may be such that, all-around the inner casing, that portion which underlies the antenna-holding portion of the outer face of the side wall of the inner casing projects outwardly, and such that the outer face of the antenna-holding portion of the side wall of the inner casing may be covered with the front case.

Further, the antenna may be positioned wherever the outer face of the inner casing is covered by the outer casing.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2006-178678 filed on Jun. 28, 2006 and including specification, claims, drawings and summary. The disclosure of the above Japanese Patent Application is incorporated herein by reference in its entirety.

What is claimed is:

1. A mobile radio communication device comprising:

first and second antennas having different communication frequencies, the first and second antennas each having a main antenna body and a feed end;

a circuit board on which a plurality of electronic elements are mounted;

an inner casing housing the circuit board, the inner casing having an outer circumference surface on which an antenna aperture is formed, an outer casing covering the inner casing; and a water-proof packing accommodated in and sealing inside the antenna aperture to prevent water from entering into the inner casing through the antenna aperture;

wherein the first and second antennas are each partially embedded in the water-proof packing, the main antenna bodies of the first and second antennas being exposed to an outside of the inner casing through the water-proof packing and disposed along the outer circumference surface, and the feed ends of the first and second antennas being exposed to an inside of the inner casing through the water-proof packing and connected to the circuit board housed inside the inner casing; and wherein the main antenna body of the first antenna is disposed in a first direction along a radial direction of the outer circumference surface of the inner casing, and the main antenna body of the second antenna is disposed in a second direction, which is different from the first direction along the radial direction of the outer circumference surface of the inner casing.

2. The mobile radio communication device according to claim 1, wherein:

the antennas are provided with positioning holes, the inner casing is provided with position pins on the outer circumference surface of the inner casing, and the positioning pins are operable to be inserted into the positioning holes to mount the first and second antennas to the inner casing.

3. The mobile radio communication device according to claim 1, wherein:

the first direction in which the main antenna body of the first antenna is disposed is a circumferential longitudinal direction of the outer circumferential surface of the inner casing, the second direction in which the main antenna body of the second antenna is disposed is another circumferential longitudinal direction of the outer circumferential surface of the inner casing, and the first direction is opposite to the second direction.

* * * * *